US008944045B2

(12) United States Patent
Canela Mercade

(10) Patent No.: US 8,944,045 B2
(45) Date of Patent: Feb. 3, 2015

(54) SELF-HEATABLE CONTAINER

(71) Applicant: Fast Drinks 2005, S.L., Barcelona (ES)

(72) Inventor: Santiago Canela Mercade, Barcelona (ES)

(73) Assignee: Fast Drinks 2005, S.L., Barcelona (ES)

( * ) Notice: Subject to any disclaimer, the term of this patent is extended or adjusted under 35 U.S.C. 154(b) by 76 days.

(21) Appl. No.: 13/826,113

(22) Filed: Mar. 14, 2013

(65) Prior Publication Data

US 2013/0193152 A1 Aug. 1, 2013

Related U.S. Application Data

(63) Continuation-in-part of application No. 12/668,498, filed as application No. PCT/ES2007/000425 on Jul. 13, 2007, now abandoned.

(51) Int. Cl.

| | |
|---|---|
| ***F24J 3/00*** | (2006.01) |
| ***A47J 39/00*** | (2006.01) |
| ***B65D 17/42*** | (2006.01) |
| ***A47G 23/04*** | (2006.01) |
| ***B65D 81/34*** | (2006.01) |
| ***B65B 1/02*** | (2006.01) |

(52) U.S. Cl.

CPC ..... *A47G 23/04* (2013.01); *B65D 81/3484* (2013.01); *B65B 1/02* (2013.01)

USPC ..... 126/263.09; 220/277; 220/592.22

(58) Field of Classification Search

CPC ..... B65D 81/3484; B65D 81/3222; B65D 51/2835; A47J 36/28; F24J 1/00

USPC ..... 220/592.16, 277, DIG. 10; 126/263.01–263.1; 426/523, 109; 206/219, 204; 62/4

See application file for complete search history.

(56) References Cited

U.S. PATENT DOCUMENTS

| | | | | |
|---|---|---|---|---|
| 3,970,068 | A * | 7/1976 | Sato | 126/263.08 |
| 4,528,218 | A * | 7/1985 | Maione | 62/86 |
| 5,255,812 | A * | 10/1993 | Hsu | 220/277 |
| 5,388,565 | A | 2/1995 | Ou | |
| 5,421,472 | A | 6/1995 | Beckertgis | |
| 5,461,867 | A | 10/1995 | Scudder et al. | |
| 5,626,022 | A | 5/1997 | Scudder et al. | |
| 5,941,078 | A | 8/1999 | Scudder et al. | |
| 6,266,879 | B1 * | 7/2001 | Scudder et al. | 29/890.035 |
| 6,880,550 | B2 | 4/2005 | Miller et al. | |
| 6,986,345 | B2 | 1/2006 | Kolb | |

(Continued)

FOREIGN PATENT DOCUMENTS

| | | | |
|---|---|---|---|
| CA | 2235678 | A1 | 5/1997 |
| WO | 03/036186 | A1 | 5/2003 |

(Continued)

*Primary Examiner* — Bryon Gehman
*Assistant Examiner* — Shawn M Braden
(74) *Attorney, Agent, or Firm* — Brown & Michaels, PC

(57) ABSTRACT

A self-heating container and a method of manufacturing the container. The container has a simple structure in which the metallic outer body holds the consumable product, and a metallic inner body and plastic housing contain the two components which react to produce the heat for the self-heating function. A lower lid is crimped over flanges on the lower ends of the inner body and the outer body, forming a double seal. When a flexible portion of the housing is pressed, a seal is punctured, causing the two components to mix and generate heat through an exothermic chemical reaction which heats the contents of the container.

8 Claims, 4 Drawing Sheets

(56) References Cited

U.S. PATENT DOCUMENTS

| | | | | |
|---|---|---|---|---|
| 8,001,959 | B2 | 8/2011 | Ford et al. | |
| 2002/0117163 | A1 | 8/2002 | Searle | |
| 2002/0129610 | A1* | 9/2002 | Searle | 62/4 |
| 2007/0131219 | A1* | 6/2007 | Ford et al. | 126/263.09 |
| 2008/0271729 | A1 | 11/2008 | Kolb | |

FOREIGN PATENT DOCUMENTS

| | | | |
|---|---|---|---|
| WO | 03/064283 | A1 | 8/2003 |
| WO | 2004/022450 | A1 | 3/2004 |
| WO | 2007016416 | A2 | 2/2007 |
| WO | 2007/059122 | A1 | 5/2007 |

* cited by examiner

SELF-HEATABLE CONTAINER

REFERENCE TO RELATED APPLICATIONS

This is a continuation-in-part of co-pending parent patent application Ser. No. 12/668,498, entitled "Self-Heating Container", which was a National Stage entry under 35 USC 371 of PCT International Application PCT/ES2007/000425, filed Jul. 13, 2007. The aforementioned application is hereby incorporated herein by reference.

BACKGROUND OF THE INVENTION

1. Field of the Invention

The present invention relates to a self-heatable container. The field of the invention is that of the preparation of containers intended to contain food products, especially beverages, soups and the like, which can be consumed at a temperature greater than room temperature and in any place, particularly when specific heating means are not available.

2. Description of Related Art

Several types of self-heatable containers provided with incorporated means for the local generation of heat in order to increase the temperature of a beverage up to a certain value are known. Among these are those described in PCT published application WO03/064283.

The models of containers provided with incorporated heating means which have been disclosed have certain drawbacks, such as their complex structure demanding complicated and therefore expensive manufacturing processes. In addition, some types described in patents have a questionable suitability, given the technical difficulty in maintaining the constitutive parts thereof hermetically joined.

In other cases, the functional and shape design of the proposed containers is scarcely suitable for the intended purpose.

There currently exist several models of self-heatable containers, for example Scudder, U.S. Pat. No. 6,266,879, which provides a plastic container with a double bottom which supports the inner body containing the reagent product. At the same time a certain amount of water is placed in another smaller body, which when it comes in contact with the reagent produces an exothermic reaction that causes the inner body to heat at high temperature and that heats the consumable included in the outer container. When the container is made of plastic, it is easy to manufacture, but there is an important risk due to the high temperature reached. Fissures or punctures or distortions might appear in the container containing the reactive product, such that the reactive product might come into contact with the consumable, making it unfit for consumption.

Metal containers for beer and soft drinks that contain carbon dioxide must work without leakage of any kind, in particular when the container is shaken and the gas fizzes and the pressure increases on the inside. These containers have a closed lid which is fixed by a double fold of both elements about themselves, for example in Beckertgis, U.S. Pat. No. 5,421,472 a closure of this kind is described.

Therefore, it is desirable to have a container provided with its own heating means, which has a suitable structure and is easy to use and which reaches temperature levels suitable for the type of product contained relatively quickly.

SUMMARY OF THE INVENTION

The invention relates to a self-heating container and a method of manufacturing the container. The container has a simple structure in which the metallic outer body holds the consumable product, and a metallic inner body and plastic housing contain the two components which react to produce the heat for the self-heating function. A lower lid is crimped over flanges on the lower ends of the inner body and the outer body, forming a double seal. When a flexible portion of the housing is pressed, a seal is punctured, causing the two components to mix and generate heat through an exothermic chemical reaction which heats the contents of the container.

The inner container fits within a smaller-diameter bottom area of the outer body, and flanges of the inner container and outer container are crimped together with a single bottom lid to form a double seal which closes and supports the elements of the container. The double seal safely seals the two reactive components within the inner container, and the inner container within the outer container.

Because of the nature of the design, the inner body in which the exothermic reaction occurs is in contact the consumable not only at the bottom of the inner body (as would happen if both the inner body and the outer body were of the same diameter and were fitted without any space between them), but also on its side walls, in the area between the inner body and outer body.

The flanges of the inner body and outer body match up and overlap each other before the bottom lid is fitted, so that when the lid is placed on the container, both flanges are joined within the lid, forming the double seam. This allows the use of conventional machines for this operation since it is identical to the placement of a lid on a container of soft drinks or beer. This allows ensuring the tightness not only of the container as a whole, but also of the seal between the inner and outer bodies, making sure that there will be no transfer of reagent to the consumable.

This process takes place with safety and efficiency as a result of the design of the parts forming the container and the associated device thereof. Because both the outer body and inner container are made of metal, the container

DETAILED DESCRIPTION OF THE INVENTION

Structure of the Container

Figure 1:
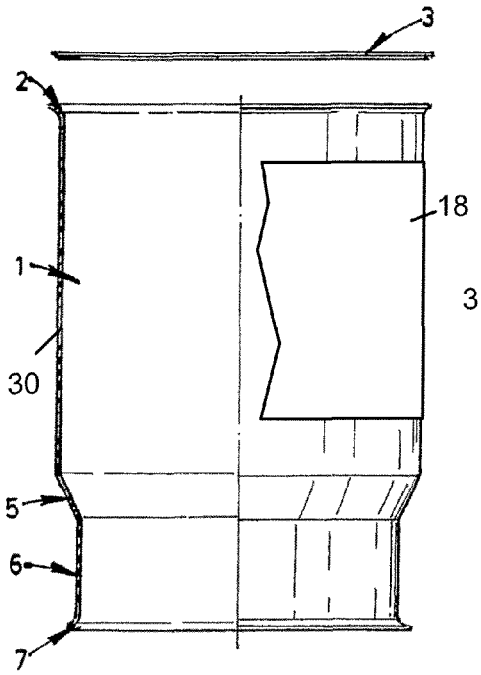
FIG. 1 is an exploded view of the container, depicted upright with the upper lid at the top.
Figure 2A:
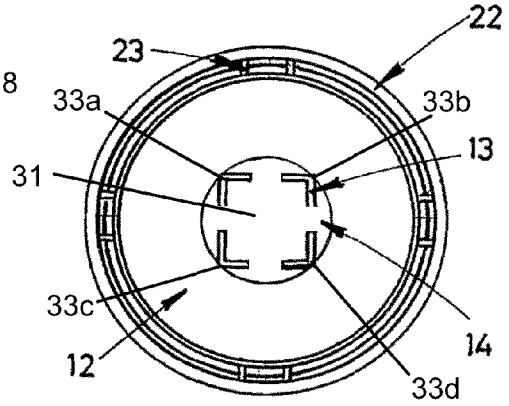
FIG. 2*a* is a top view of the housing.
Figure 2B:
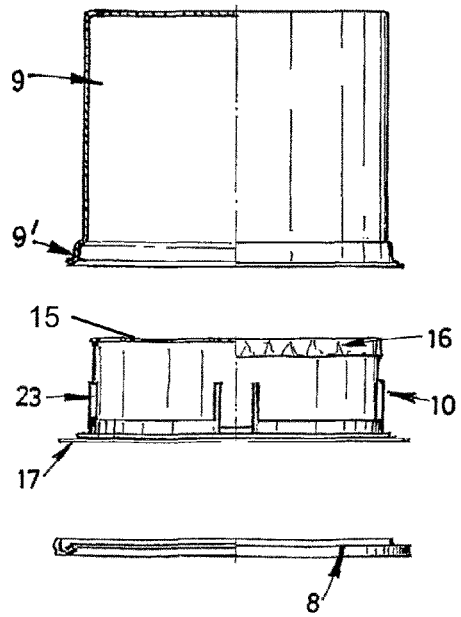
FIG. 2*b* is an exploded, cut-away side view of the housing.
Figure 2B:
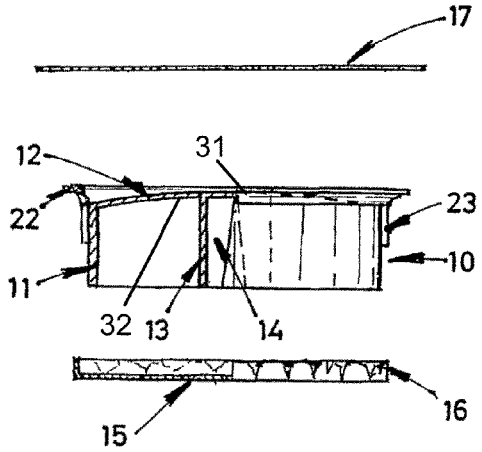
Figure 3:
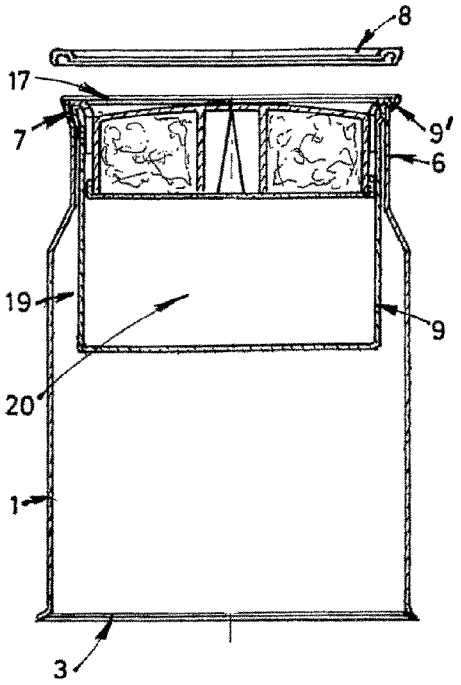
FIG. 3 is a cut-through view of the container, bottom end upward, prior to crimping the bottom lid.
Figure 5:
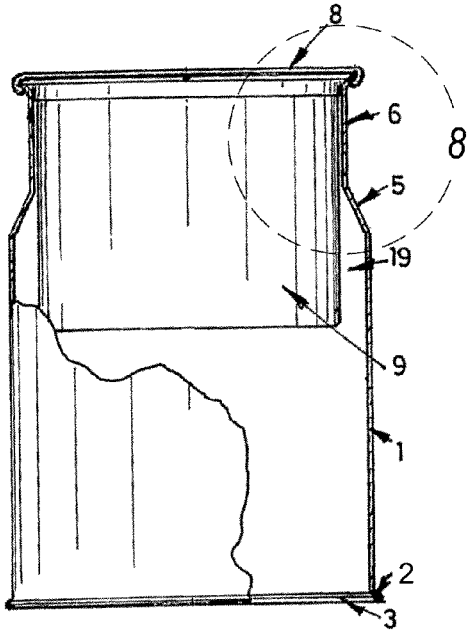
FIG. 5 is a side view of the container, bottom end upward, after crimping the bottom lid, with the outer body partially cut away to show the inner body fitting within the outer body.

As can be seen in FIG. 1, the container has five major parts: outer body 1, inner body 9, housing 10, upper lid 3 and lower lid 8.

The outer body 1 contains the consumable product, such as a beverage, soup or the like. Outer body 1 is preferably cylindrical in shape, and is made of a metallic material of a suitable thickness. The upper edge of the outer body forms a flange 2, which is crimped together with the periphery of upper lid 3, as is conventional with beverage cans or the like.

The lower part 6 of the outer body 1 has a smaller diameter than the upper part 30 of the outer body 1, with the two sections 6 and 30 joined by tapered area 5. The bottom edge of lower part 6 forms a flange 7.

The inner body 9, within which the chemicals which heat the can will be contained, consists of a cylindrical metallic body having a closed upper end, and the lower end of the inner body 9 is formed into a projecting flange 9'. The inner body 9 has a length greater than the length of the lower part 6 of the outer body, so that when the lower body 9 is inserted into the upper body 10, the inner body 9 extends from the lower flange 7 past tapered area 5 into the upper part 30.

Figure 8A:
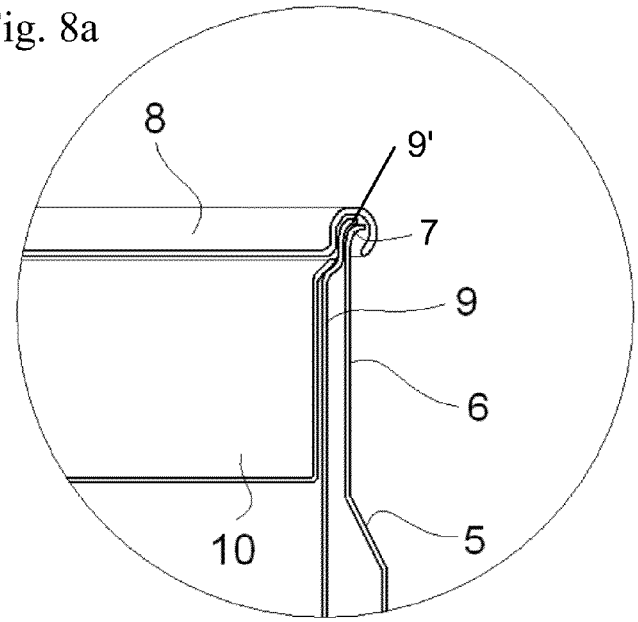
FIGS. 8*a* and 8*b* are details of the crimping process, showing a portion of the outer body, inner body and bottom lid, enlarged from the circled area denoted "8" in FIG. 5.
Figure 8B:
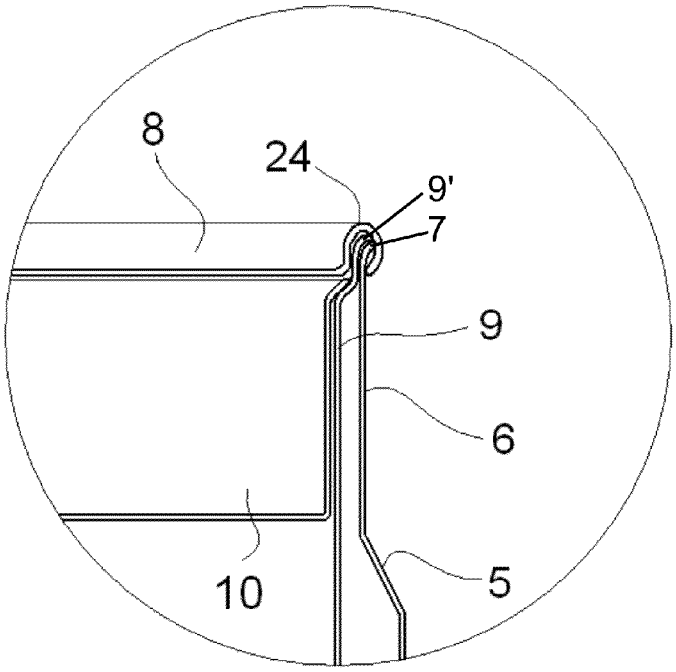

The diameter of the projecting flange 9' of inner body 9 is of approximately the same diameter as the flange 7 of the bottom edge of lower part 6 of the outer body 1, so that when the inner body 9 is placed into the upper body 1, the flanges 9' and 7 overlap and are located together as shown in FIGS. 8*a* and 8*b*.

As can be seen in FIGS. 2*a* and 2*b* and FIGS. 6 and 7, housing 10 is generally cylindrical, and is preferably made of a plastic material. The housing 10 has a diameter which is somewhat smaller than the diameter of inner body 9, so that the housing 10 will fit within inner body 9. The length of housing 10 is less than that of inner body 9, preferably about one-quarter to one-third of the length of inner body 9, so that when housing 10 is within inner body 9 a chamber 20 is formed within the inner body 9, as will be discussed further below.

The side part 11 of housing 10 is are relatively thick so as to have a resistance to deformation, whereas base 12 of housing 10 is of a reduced thickness so as to be flexible in its central part 31, which is curved to define a dome. On the upper surface 32 of the central portion 31 is a projection 13. Projection 13 preferably has a square cross-section with four sides meeting at right-angles. Cuts 14 are preferably made in the sides, so as to form four fingers 33*a*-33*d*, each with an L-shaped or right-angled shape.

A thin disc-shaped seal 15 of thin, pierceable aluminum foil or similar material, closes the upper end of the housing 10, sealed around its edges to the upper rim 16 of the housing 10. The length of the projection 13 is such that when the domed part 31 of the base 12 is pushed fully upward, the ends of the projection protrude slightly from the upper end of the housing 10, puncturing the seal.

The lower end of the housing 10 is formed into a lip 22, which is closed by filter 17, a disc of a porous material. The filter 17 is made of a flexible, porous and air-permeable and also moisture-absorbing material. Openings 21 are formed in the lip 22 to provide air passages between the outside atmosphere and the inside of the inner body 9 and assure that the reaction always occurs at atmospheric pressure. Ribs 23 reduce to a minimum the amount of calcium hydroxide in powder form, resulting from the reaction, which could be deposited from the inside of inner body 9 onto the filter 17.

When all of the components are assembled, with the inner body 9 inside the outer body 1 and the housing 10 inside the inner body 9, the lower lid 8 is fixed over the flanges 7 and 9' by the double seam 24, which closes and holds all the components of the heating module associated with the container.

Figure 10:
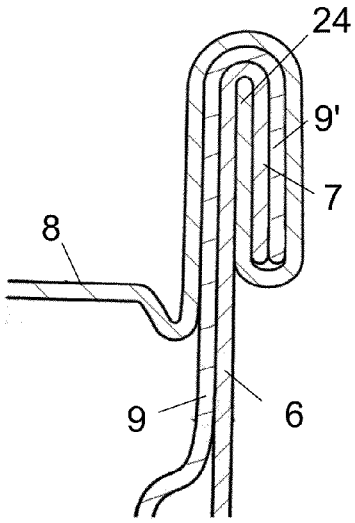
FIG. 10 shows a detail of the double-seam crimp, in another embodiment.

FIG. 10 shows another embodiment of the double seam 24, in which flanges 7 and 9' are bent back over parallel to the sides 6 and 9 and the edge of lid 8 is crimped over to entirely enclose the flanges in the double seam 24.

It is preferred to have a protective element for the user's lips, such as a ring made of an insulating material, around the lip 2 of the outer body 1. The protective element does not form part of the container, and is not shown in the drawing.

Method of Assembly of the Container

Figure 9:
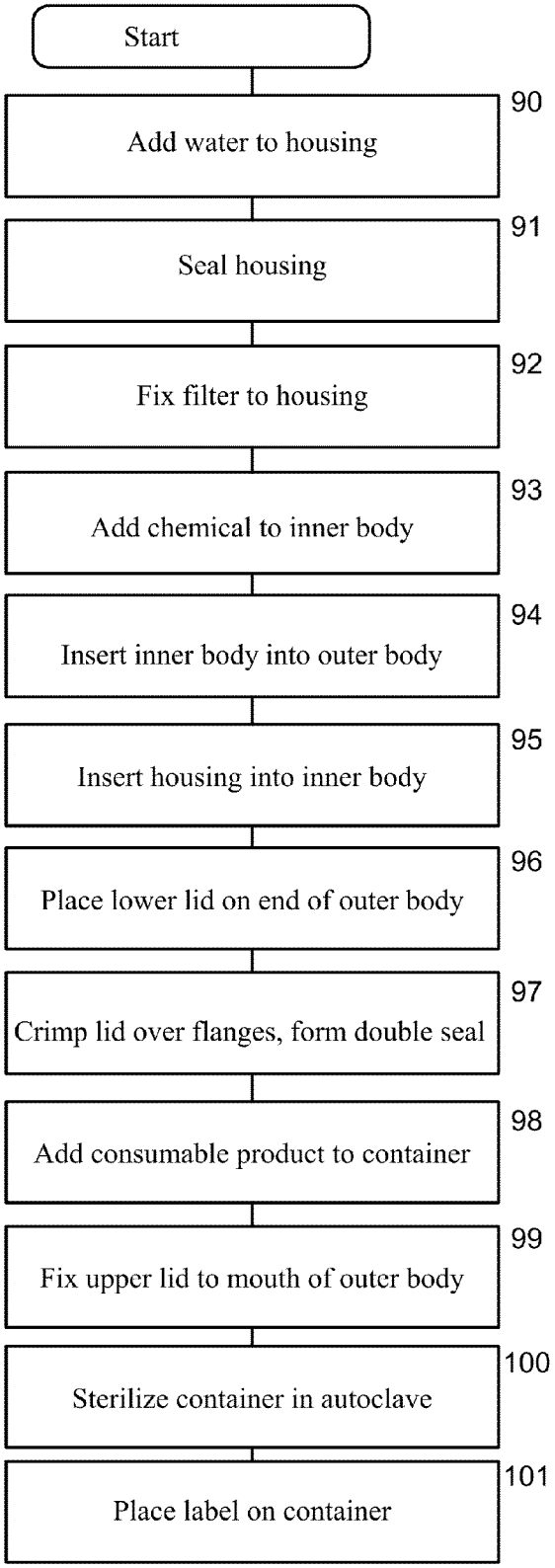
FIG. 9 shows a flowchart of the method of assembly of the container.

The assembly of the self-heatable container described above can be stated as follows, with reference to FIGS. 3, 5 and 8*a*-8*b*, and as shown in the flowchart of FIG. 9:

90. A predetermined amount of water is placed in the housing 10.

91. Housing 10 is hermetically closed by fastening seal 15 to the rim 16 of the housing 10, the inner face of the seal 15 being supported on central projection 13 and its fingers 33*a*-33*d*.

92. Filter 17 is fixed to the opposite end of the housing 10 from the seal 15.

93. A predetermined amount of a chemical such as calcium oxide which, upon contact with water, will give rise to an exothermic reaction, is placed in the inside 20 of inner body 9.

94. The inner body 9, loaded with the chemical, is inserted into the smaller-diameter lower part 6 of the outer body 1. The flange 9' of inner body 9 will seat against flange 7 of outer body 1.

95. Housing 10 is inserted into the inner body 9.

96. Lower lid 8 is placed on the lower end of the container, with the rim of the lid 8 over flanges 7 and 9', as shown in FIG. 8*a*.

97. The rim of lower lid 8 is crimped over flanges 7 and 9', forming double seal 24 as shown in FIG. 8*b*. The double seal 24 assures the hermetic closing of this end part of the container, i.e., the associated edges of the lid 8, the outer body 1 and the inner body 9, thus locking inner body 9 and container 10 with respect to the outer body 1.

98. Inverting the position of the container to the position of FIG. 1, the desired amount of the consumable product (food, beverage or the like), the consumption of which will optionally take place after heating, is poured through the upper mouth 2 of the outer body 1. The product bathes the upper and side part of the container 9 and likewise occupies the area 19 between the outer body 1 and the inner body 9.

99. Finally the upper lid 3 is placed over the mouth 2 of the outer body 1, and upper lid 3 is fixed to the mouth 2 by a conventional peripheral crimp.

100. Optionally, the finished container (with its heating module incorporated) can be sterilized in an autoclave at a temperature and pressure suitable for the characteristics of the product. The sterilization is possible given the simplified configuration and the metallic nature of the new container.

101. The container can be finished with the placement of a preferably tubular and laminar label 18.

Method of Operation of the Container

In order to heat the consumable product contained in the body 1, the lower lid 8 is partially removed, with the outer rim of the lower lid 8 being retained by the crimp 24. This reveals filter 17 and, behind it, the flexible dome 31 or central part of the base 12 of housing 10 is exposed.

Figure 4:
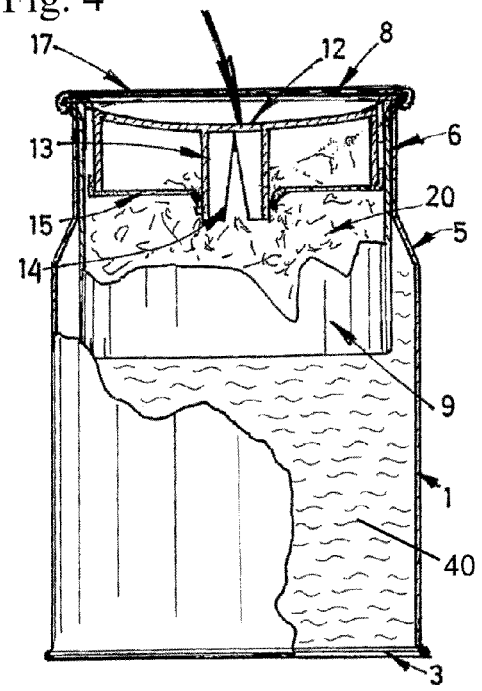
FIG. 4 shows a partially cut-through view of the container, showing the operation of the flexible portion of the housing and also how the consumable in the container contacts the inner body.
Figure 6:
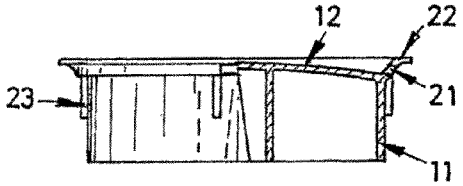
FIGS. 6 and 7 are sectional details of the housing.
Figure 7:
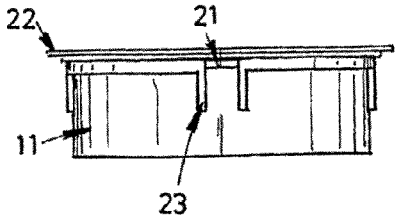

As shown in FIG. 4, the flexible dome 31 in the base 12 is pressed, whereby the projection 13 moves in an axial direction and its fingers 33*a*-33*d* tear seal 15. This allows the water contained in housing 10 to flow into the interior 20 of inner body 9. The water contacts the chemical, for example calcium oxide, contained in the interior 20, initiating an exothermic chemical reaction. This reaction causes a considerable increase of the temperature of the inner body 9.

The container with its contents is shaken for a period of time, for example 10 seconds, to facilitate the mixture of the water and chemical in the interior 20 of inner body 9, and the container is again inverted, leaving it face up as shown in FIG. 1.

In less than 30 seconds the heating is noted due to the exothermic chemical reaction, which gives rise to a considerable increase of the temperature of the surface of inner body 9 and, as a result, of the consumable product 40, which, as can be seen in FIG. 4, is in contact not just with the end of the inner body 9, but is also in contact with the cylindrical walls of inner body 9, in the area 19 between the inner body 9 and the outer body 1.

The wall of the outer body 1 is also heated as the contents heat. This could be to a temperature as high as 65-70° C., since the container is designed so that the temperature of the content rises from 38 to 40° C. with respect to the environment. To that end and to prevent the inconvenience and risk of burning for the user when holding the outer body 1 of the container, the label 18 is preferably made of a heat-insulating material, such as polystyrene.

Finally, the user, in less than 3 minutes, can open the mouth of the container by opening the upper lid 3 and have access to the heated contents.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A self-heatable container for a consumable product, comprising:

a metallic hollow outer body for receiving the consumable product, having an upper edge forming an upper flange and a bottom edge forming a lower flange, the outer body comprising an upper part having a length and a diameter and a lower part having a length and a diameter, the diameter of the lower part being smaller than the diameter of the upper part, with a tapered area formed between the upper part and the lower part;

an upper lid fastened around a rim to the upper flange;

a metallic inner body, received within the outer body, having a length greater than the length of the lower part of the outer body, a diameter smaller than the diameter of the lower part of the outer body, a closed upper end and a lower end forming a projecting flange, the projecting flange being sized such that when the inner body is fully received within the lower part of the outer body, the projecting flange overlaps the lower flange of the outer body, supporting the inner body within the outer body;

a housing, received within the inner body, comprising:

a cylindrical body having a diameter smaller than the diameter of the inner body, an upper end and a lower end and a length therebetween, the length of the cylindrical body of the housing being smaller than the length of the inner body, a lip on the lower end of the cylindrical body having a diameter larger than the diameter of the inner body, such that when the housing is received within the inner body, the housing is supported by the lip, and a chamber is formed between the upper end of the cylindrical body of the housing and the closed upper end of the inner body;

a flexible base having a domed center, a rim of the flexible base being connected to the lower end of the cylindrical body of the housing, inside the lip;

a projection having a lower end centrally mounted on an upper surface of the flexible base, an upper end extending into the cylindrical body of the housing, and a length between the upper end and the lower end;

a seal closing the upper end of the cylindrical body of the housing; and the length of the projection being sufficient that when the domed center of the flexible base is depressed, the upper end of the projection protrudes from the upper end of the housing a distance sufficient to puncture the seal; and a lower lid having a rim and diameter sized such that when the lower lid is placed over the projecting flange of the inside body and the lower flange of the outer body, the rim of the lower lid can be crimped over the projecting flange of the inner body and the lower flange of the outer body, forming a double seal.

2. The self-heatable container of claim 1, wherein the cylindrical body of the housing is made of plastic.

3. The self-heatable container of claim 1, further comprising a filter closing the lip on the lower end of the housing.

4. The self-heatable container of claim 1, further comprising a determined amount of a chemical which, upon contact with water, will give rise to an exothermic reaction, in the chamber between the upper end of the housing and the upper end of the inner container, and an amount of water, held in the cylindrical body of the housing by the seal, such that when the domed center of the flexible base is depressed, the upper end of the projection punctures the seal, allowing the water to mix with the chemical in the chamber, causing an exothermic reaction and heating the container.

5. The self-heatable container of claim 4, in which the chemical is calcium oxide.

6. The self-heatable container of claim 1, in which the projection has a square cross-section having four sides meeting at right angles, the sides having cuts such that the projection forms four L-shaped fingers.

7. The self-heatable container of claim 1, in which the seal is made of aluminum foil.

8. The self-heatable container of claim 1, in which the lip has a plurality of openings to provide an air passage from outside atmosphere to the inner body.

* * * * *